US005218809A

United States Patent [19]

Baumann

[11] Patent Number: 5,218,809

[45] Date of Patent: Jun. 15, 1993

[54] EARTHQUAKE RESISTANT STRUCTURE UTILIZING A CONFINEMENT REINFORCING FRAMEWORK

[76] Inventor: Hanns U. Baumann, 312 Emerald Bay, Laguna Beach, Calif. 92651

[21] Appl. No.: 640,923

[22] Filed: Jan. 14, 1991

Related U.S. Application Data

[63] Continuation-in-part of Ser. No. 523,450, Apr. 14, 1990, abandoned.

[51] Int. Cl.[5] ..... E04H 12/00

[52] U.S. Cl. ..... 52/653.1; 52/426

[58] Field of Search ..... 52/251, 252, 258, 295, 52/262, 275, 300, 426, 427, 431, 565, 653

[56] References Cited

U.S. PATENT DOCUMENTS

| | | | |
|---|---|---|---|
| 2,815,656 | 12/1957 | Klein et al. | 52/258 X |
| 3,238,684 | 3/1966 | Wood | 52/426 X |
| 4,454,702 | 6/1984 | Bonilla-Lugo et al. | 52/251 X |

*Primary Examiner*—Carl D. Friedman
*Assistant Examiner*—Creighton Smith
*Attorney, Agent, or Firm*—Stetina & Brunda

[57] ABSTRACT

In a poured concrete or masonry structure having reinforcing bars, an improvement is provided whereby a series of parallel, steel reinforcing frames are positioned at right angles to the reinforcing bars. Each frame comprises a prefabricated weldment of mutually parallel longitudinal rods and mutually parallel transverse rods forming a network of rectangular openings. The frame acts as a reinforcing perimeter in contact with the reinforcing bars to absorb shear forces and resist buckling. In the case of a poured concrete wall structure, the ends of the transverse rods may be bent upwardly into hooks for improved weld strength and for hanging further reinforcing materials. The invention improves the ductility of structures such as walls, columns and beams thereby providing an improvement in resistance to dynamic loads. Larger preassembled reinforcing frames may be lifted into place thereby reducing construction costs. Moreover, the reinforcing frames comprise, along with the reinforcing bars, an overall reinforcing framework that provides access passageways for inserting concrete compacting equipment within the structure.

9 Claims, 5 Drawing Sheets

EARTHQUAKE RESISTANT STRUCTURE UTILIZING A CONFINEMENT REINFORCING FRAMEWORK

This patent application is a continuation-in-part of Applicant's previous patent application, entitled "CONFINEMENT REINFORCING FRAME", filed Apr. 14, 1990 and granted Ser. No. 07/523,450 now abandoned.

BACKGROUND OF THE INVENTION

This invention relates generally to an earthquake resistant reinforced wall structure for concrete and masonry structures. More particularly, this invention relates to a construction approach utilizing a reinforcing framework to improve the load bearing characteristics, especially of dynamic loads, of walls, columns and other structural elements built in accordance with the present invention.

The construction industry has repeatedly tried to address a multitude of long-standing problems, foremost among these problems are concerns directed to the achievement of a wall construction having structural strength sufficient to resist earthquakes, and concerns directed towards saving material costs and assembly time during construction. Another pertinent long standing problem in the construction field is the general inability to provide extensive access within walls for the use of concrete compacting equipment therein. A closer look at these long-standing problems will allow one to fully appreciate the solutions offered by the invention to be described herein.

Building codes, which govern construction, require reinforcement in structures made of concrete and masonry materials such as shear walls, columns and beams, so that these structures will ". . . carry all factored gravity loads . . . including tributary loads and self weight, as well as the vertical force required to resist overturning moment calculated from factored forces related to earthquake effect" (as stated in an American Concrete Institute Committee report).

The construction field currently employs practices that have evolved during a long-standing preoccupation with the aspect of achieving an acceptable degree of structural strength in free-standing structures. Generally, when acted upon by external forces, such as earthquake and high velocity wind gusts, a free-standing structure will experience tensile strain on one side and compressive strain on the opposite side. This condition will alternate cyclically. For this reason, building codes require that vertical steel reinforcing bars be placed at both ends of each wall or other structure. Under compressive loading, these reinforcing bars tend to fail by buckling so that builders are required to further reinforce the reinforcing bars with lateral restraints such as hoops placed on prescribed minimum centers. Two common prior forms of transverse constraints are first, a steel rod spirally wound about the perimeter of the vertical reinforcing bars, and second, a series of vertically spaced transverse "hoop ties" connecting the reinforcing bars around their periphery. Disadvantageously, both of these prior transverse constraints must be custom formed either off site or at the construction site. The prior type of transverse constraints are then mounted into place by craftsmen and are manually tied to the vertical reinforcing bars with wires.

In prior construction methods, after a reinforcing framework is completed using prior transverse constraints, concrete is poured within boundary forms to complete the structure.

Using prior construction techniques, the resultant structure's performance under load is determined to a great extent by the quality of workmanship in forming and typing prior transverse constraints into place. Usually, weakness in a structure that is conventionally reinforced can be traced mainly to: 1) loosely fitting transverse elements and 2) voids in the concrete due to poor compaction. With regard to factor #2, another long-standing problem in construction is highlighted. Conventionally, vibratory compactors are utilized within free standing structure during the pouring and setting of concrete during construction. The compactors use vibrations to cause a wet concrete flow to achieve an even distribution of concrete. The compactors densify concrete, thereby eliminating air pockets and voids in the concrete before said concrete dries with void-related weak points therein. Unfortunately, current construction practices hinder the use of compactors by limiting access for the use thereof. This is due, in large part, by the accepted practice of using convention confinement "rebar" (short for reinforcing bar) ties having seismic hooks or other protrusions that hinder the insertion of vibratory compactors into a structure. Often, conventional reinforcing arrangements present obstacles that block free access for proper, extensive use of compactors. The resultant limitations upon effective compacting action causes an increase in the size and frequency of voids in the finished structure, thus reducing the strength and dynamic load carrying characteristics of the finished structure.

As mentioned previously, structures being subjected to an earthquake generally are subjected to cyclic loading. A problematic aspect of such cyclic loading is that extremely large vertical shear forces are generated near the ends of structural walls. These vertical shear forces disasterously tend to separate the ends of a structure from its more central portions because traditional prior lateral reinforcing spirals and hoops do not effectively transfer end loading stresses to central areas of a structure.

The construction industry both in the United States and abroad has recently begun to realize that conventional methods of reinforcing concrete shear walls, columns and beams, using rebar hoops with hooked ends, including typing procedures for columns, and other methods applicable to shear wall construction are inadequate to provide structural stability during earthquakes. A higher precision in the positioning of boundary reinforcing bars to uniformly resist compressive buckling is needed to address the problems currently being encountered in the construction industry. Current reinforcing methods do not provide adequate space in poured concrete for effective positioning and insertion of compacting equipment. The dilemma of improving the strength and placement precision of reinforcing steel while lowering construction costs is a long-standing problem in this field. It has been addressed, albeit inferiorly, by many prior art solutions and attempts. There exists a need, therefore, for an improved method of reinforcing free standing structures, especially walls, columns and beams, that will provide an improved fit over vertical reinforcing bars, take less space, thereby leaving more room for improved compactor access, and that will reduce both material costs and assembly time, thereby lessening installation expense.

An earthquake resistant structure is needed that utilizes an improved reinforcing framework that allows for the achievement of greater overall structure ductility and more predictable structure response to loading. Moreover, such an improved reinforcing framework is needed that will allow for close control of material and assembly tolerances, thereby allowing achievement of precision dimensions and precision positioning of lateral reinforcing elements. A needed construction improvement that would result in increased dimensional uniformity throughout the structure would facilitate the use of less concrete and smaller diameter rebars if such uniformity were achievable without a loss in structural strength. The present invention fulfills all of these needed construction improvements and provides further related advantages. The present invention advantageously greatly improves structure resistance to large dynamic loads, especially those encountered during earthquakes.

BRIEF DESCRIPTION OF THE DRAWINGS

The accompanying drawings illustrate the invention. In such drawings.

DETAILED DESCRIPTION OF THE PREFERRED EMBODIMENTS

Figures 1, 2:
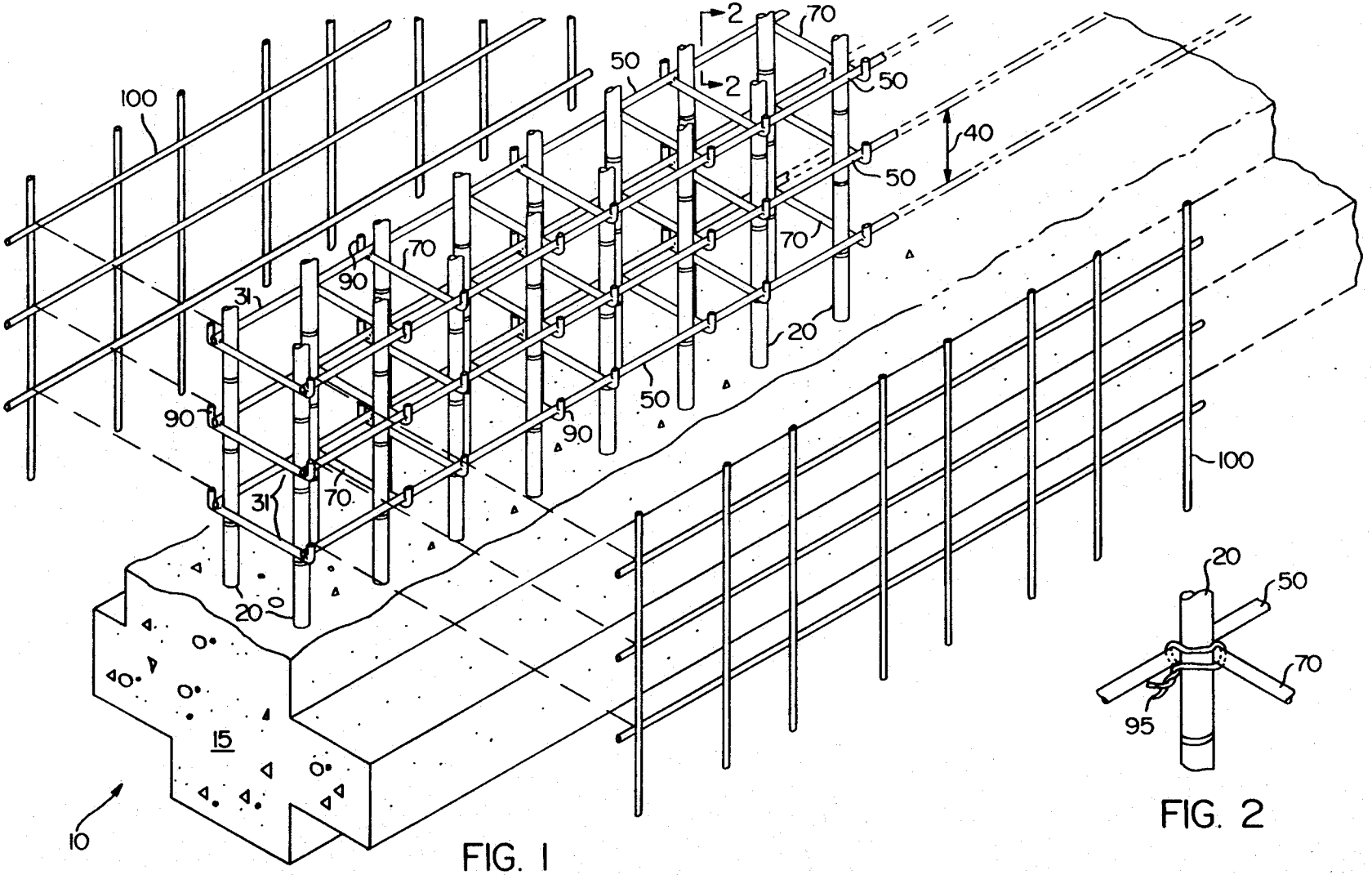
FIG. 1 is a perspective drawing showing a poured concrete wall, cutaway to expose the reinforcing framework within including vertical reinforcing bars, horizontal ladder frames and welded wire fabric for front and rear face, shown exploded outward.
FIG. 2 is a cutaway of the intersection of one vertical bar with one transverse and one lateral rod of the invention frame, showing wire tying these elements together for support of the frame; with FIG. 2 being a view taken generally along line 2—2 of FIG. 1.

As shown in FIG. 1, a poured concrete structure 10 comprises concrete 15 reinforced by vertical reinforcing bars 20 and further reinforced by the invention which utilizes confinement reinforcing frames 31 positioned horizontally with vertical separation space 40 between consecutive, vertically aligned frames 31. Each frame 31 comprises mutually parallel longitudinal rods 50 and mutually parallel transverse rods 70 forming a ladder-like structure. Opposite ends of the transverse rods 70 are extended into an upward right angle bend around longitudinal rods 50, thereby defining hangers 90 for mounting welded wire mesh 100, or other reinforcing lattices. Longitudinal rods 50 are extended an arbitrary length (to the right in FIG. 1), thereby tying vertical reinforcing bars 20 into the remainder of structure 10 which does not contain bars 20. The longitudinal rods 50 and the transverse rods 70 are joined at junctions 71 (FIGS. 3 and 4) by attachment means 60 (preferably a fusion welded joint) to form a rigid, ladder-like confinement frame 31. Moreover, once the confinement reinforcing frame 31 has been positioned about the vertical rebars 20, as shown in FIG. 1, the transverse rods 70 and the longitudinal rods 50 are secured to adjacent rebars 20 by tie wires 95. Preferably, each secured rebar 20 is tied to a confinement reinforcing frame 31 in the manner shown in FIG. 2, whereby the secured rebar 20 is nestled within a junction of a transverse rod 70 and a longitudinal rod 50 such that said rebar contacts both rods 50 and 70. However, it is not necessary that every rebar 20 which is surrounded by a confinement frame 31 be tied to whichever frame 31 is in proximity thereto. Rather, in order to reduce tying, and thus advantageously reduce assembly time, it is recommended that rebars 20 and confinement frames 31 be tied together at junctions 71 approximately every two feet along the vertical direction and approximately every two feet along the horizontal direction, or as desired and needed. An effective tie-off should place the secured rebar 20 in abutment with its associated confinement reinforcing frame 31. It is preferred that construction executed in accordance with the present invention be carried out such that all vertical reinforcing bars 20 that are to be reinforced, are encompassed by a confinement frame 31 so as to be in contact therewith, whether or not said contacted rebar is to be tied to that confinement frame 31 in contact therewith. However, as an alternative to the above-noted contact between rebars 20 and frames 31, the confinement frames may alternatively be positioned about a plurality of vertical rebars such that only some of said rebars contact an encompassing confinement frame 31, while the remainder of the rebars are in close proximity to a frame 31. Preferably, vertical rebars 20 are encompassed by confinement frames 31 such that all rebars are spaced not more than one-sixteenth of an inch away from a junction of a transverse rod 70 and a longitudinal rod 50.

Figure 3:
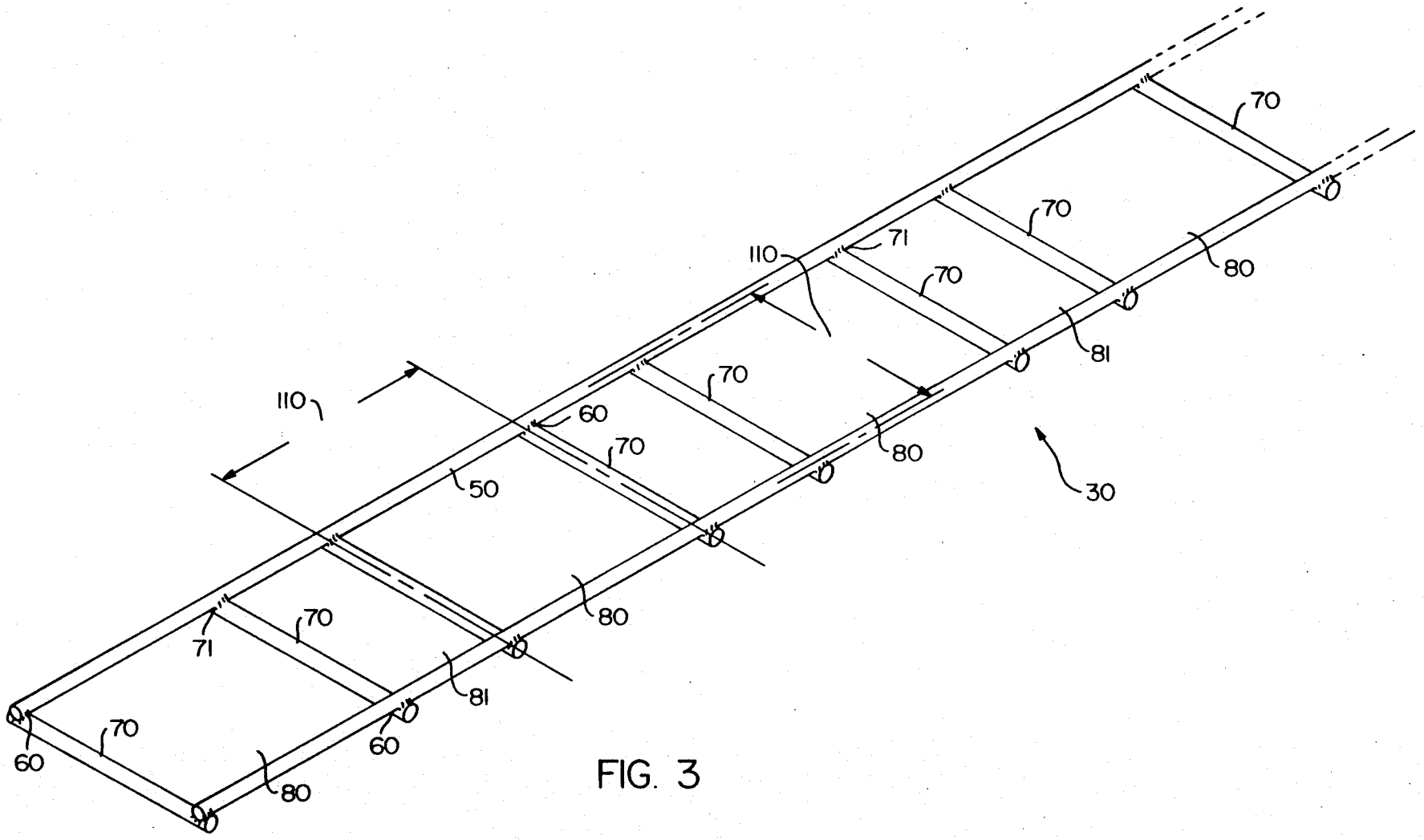
FIG. 3 is a perspective drawing of the invention frame in a first embodiment showing overlap welded construction at junctions of transverse and lateral rods.
Figure 4:
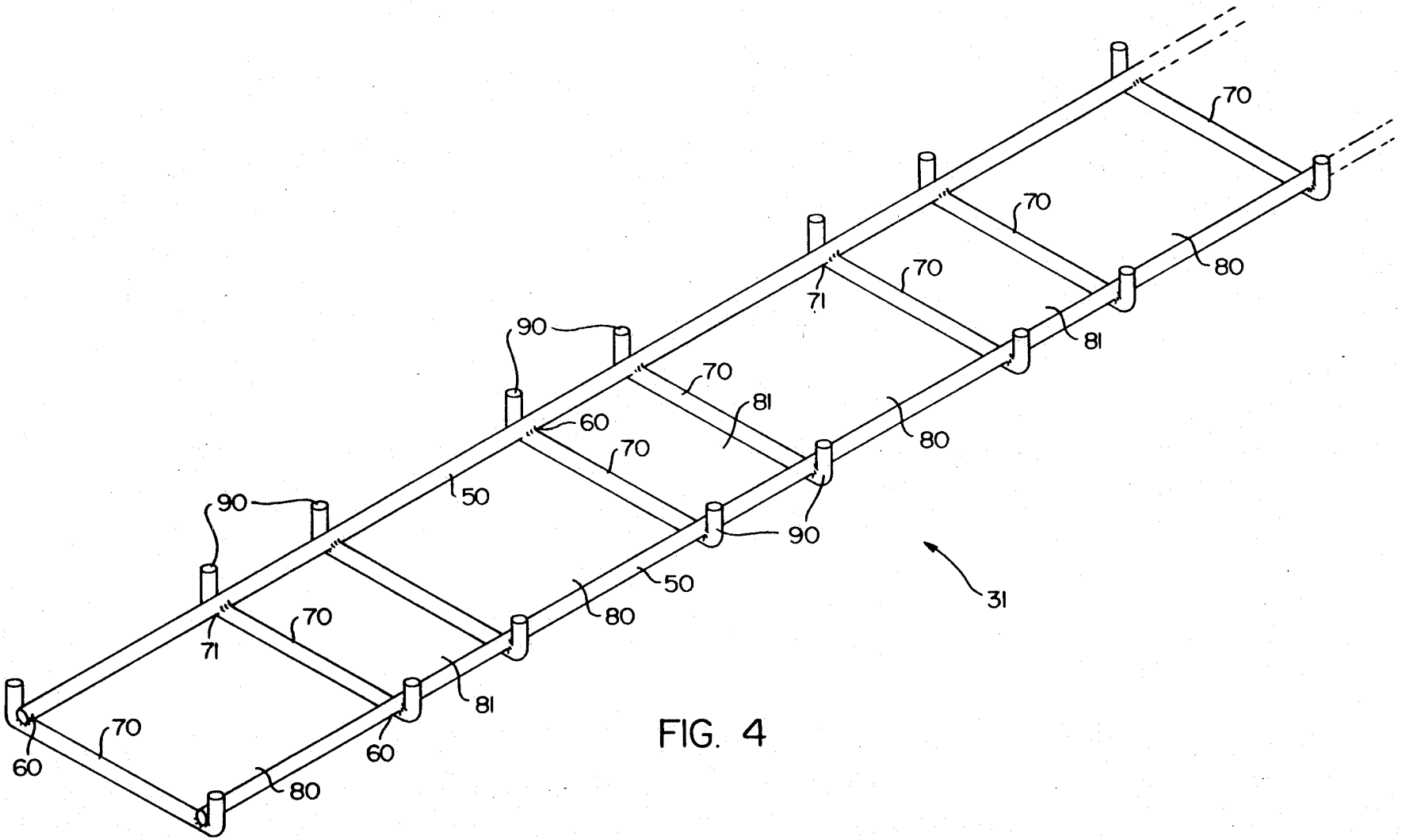
FIG. 4 is a perspective drawing of the invention frame in a second embodiment showing overlap welded construction plus bent hook ends on each transverse rod.

FIGS. 3 and 4 show the configuration of alternative embodiments of the confinement reinforcing frame 31. The preferred diameter of rods 50 and 70 comprising the frame 31 is three-eights of an inch of steel wire. Using steel wire thinly drawn through a die, one can utilize rods 50 and 70 that are as small as .25 inch in diameter. This results in a confinement frame 31 which occupies less space, an advantage in that more room will be available to space vertical rebars 20 a slightly greater distance apart (with said distance being measured perpendicular to longitudinal rods 50). This increased spacing desirably increases structural resistance to axial buckling forces. Unlike FIG. 3, FIG. 4 shows a frame 31 of FIG. 1, said frame having hangers 90 at the ends of the transverse rods 70. FIG. 3 shows a confinement frame 30 which is identical to the frame 31 of FIG. 4 except for the absence of hangers 90. When used to create a reinforcing framework in accordance with the present invention, the openings 80 in the frames 30 and 31 are positioned so that any two consecutive transverse rods 70, and the portions of the longitudinal rods 50 attached thereto, form a perimeter around, and preferably in contact with, four rebars 20 as shown in FIG. 1.

FIG. 3 shows that, rods 50, 70 are positioned in frame 30 with spacing tolerance accuracy 110 of plus or minus one-sixteenth of an inch maximum to assure a tight and rigid fit with bars 20. Rods 50, 70 are preferably made of high ultimate strength, high yield strength steel, providing optimal reinforcing characteristics to structure 10. Each alternate opening 81 (FIG. 3) is used for clearance for concrete compacting equipment. In FIG. 4, note that the hangers 90 provide significant reinforcing of the weld points 60 by abutting the longitudinal rods 50.

Figure 5:
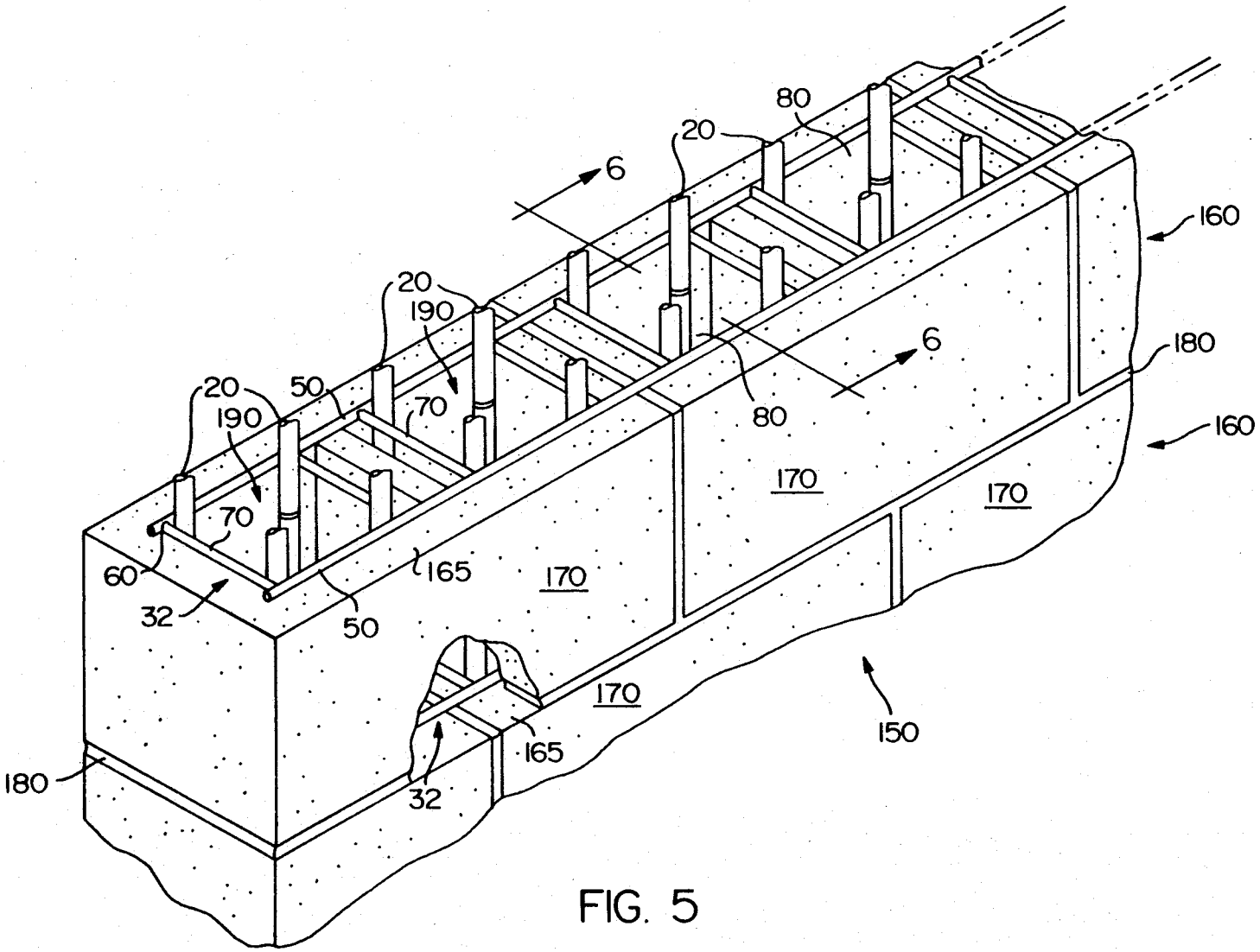
FIG. 5 is a perspective drawing showing a masonry wall with vertical reinforcing bars and illustrating the invention frame having butt welded construction.

As shown in FIG. 5 masonry structure 150 consists of courses of masonry 160 made up of blocks 170 held by grout 180 in a typical block wall construction. Conventionally, blocks 170 each have two vertical, square, through holes 190 for reinforcing bars 20 to pass through. Structure 150 is improved by placement of an alternate preferred configuration of confinement reinforcing frames 32, one frame 32 being supported by each course of masonry 160. Each frame 32 comprises parallel longitudinal rods 50, attached by attachment means 60, to parallel transverse rods 70, forming rectangular openings 80 and 81 alternating along frame 32. The rods 50 and 70 which define each rectangular opening 80 form a perimeter around and in contact with four bars 20. Concrete is poured into each through hole 190 forming a solid monolithic masonry structure 150 of blocks 170, grout 180, reinforcing rods 50 and 70, bars 20 and the concrete itself. Frame 32, which may be extended to an arbitrary length, absorbs shear forces in structure 150 and reduces the probability of buckling of reinforcing bars 20 by providing lateral support.

Figure 7:
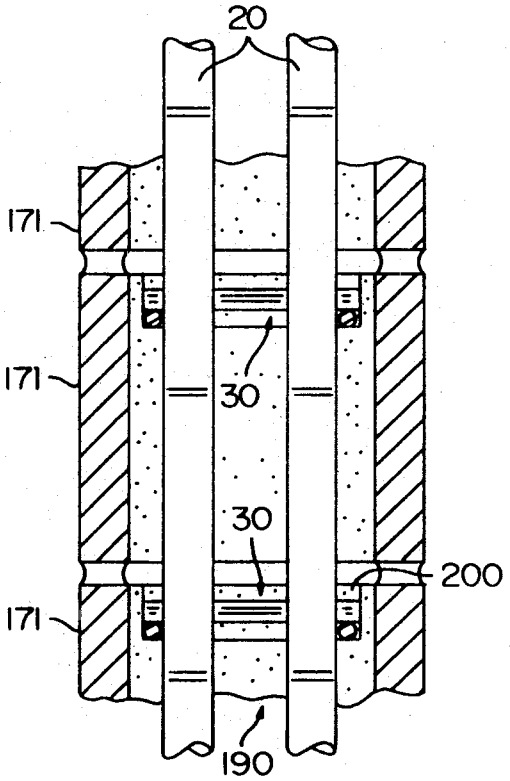
FIG. 7 is an alternative to the construction shown in FIGS. 5 and 6 whereby the invention frame shown in FIG. 3 is placed within a relief cutout in each block.
Figure 6:
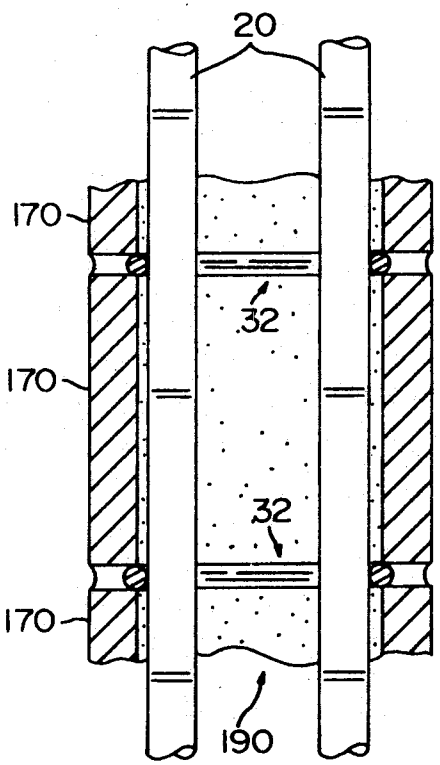
FIG. 6 is a cross sectional view of the wall of FIG. 5 showing the interior details within the wall, especially the location of the invention frame on the top surface of each course of blocks.

As shown in FIG. 6, frame 32 is placed between blocks 170. In order to maintain typical spacing between blocks 170, the height of frame 32 is reduced by using butt joints instead of overlap joints. Otherwise the general construction and configuration of frame 32 is identical to frame 30. FIG. 7 shows readily available alternate block 171 known to industry as a bond beam block, having a relief cutout 200 which can be used for placement of frame 30 into blocks 171 instead of on the top surface as is the case in FIG. 6. This permits the use of the stronger frame 30 having overlap joints instead of butt joints. This configuration has the advantage of placing frame 30 into the stronger interior of block 171 instead of in grout 180. It has the drawback of forcing bars 20 to be placed closer together, potentially weakening structure 150.

Figure 8:
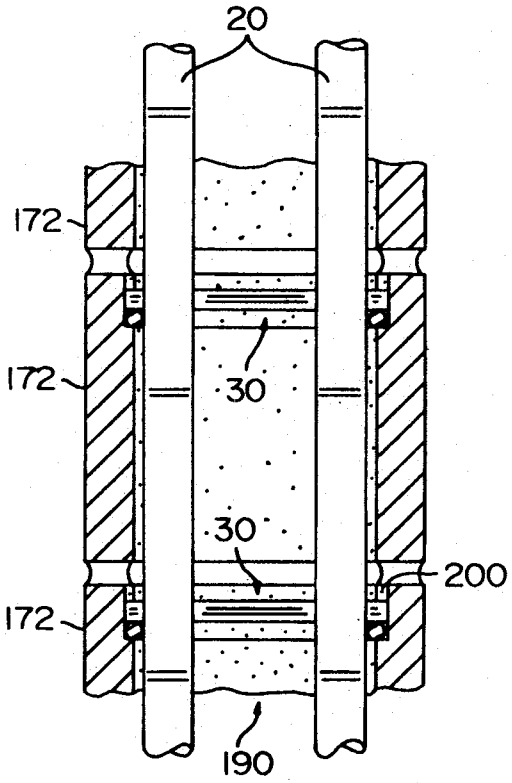
FIG. 8 is a cross sectional view similar to FIGS. 6 and 7 whereby the invention frame shown in FIG. 3 is placed within a larger relief cutout allowing the vertical reinforcing bars to be positioned further apart.

FIG. 8 shows a second version of the structural arrangement of FIG. 7, which is believed to form a stronger structure because the FIG. 8 version utilizes a block 172 having relief cutouts 200 of a greater transverse dimension than the relief cutouts 200 in FIG. 7. To quantify, FIG. 7 illustrates a conventional block having a five inch wide cutout, while FIG. 8 shows a block which has been modified in accordance with the present invention to have an enlarged cutout that is approximately six and one-half inches wide. The significance of the enlarged cutout of FIG. 8 is that the enlarged cutout allows rebars 20 to be placed further apart, thereby achieving improved wall strength by increasing the ability of the structure to resist axial buckling forces.

I claim:

1. An improved earthquake resistant, load-bearing, concrete structure comprising:

a plurality of load-bearing vertically oriented reinforcing bars of a given diameter;

a load-bearing concrete mass enveloping and bonded to all of said vertical reinforcing bars, said reinforcing bars and said concrete mass being interlocked by means of a reinforcing framework that is engaged by concrete poured thereabout and that encompasses a plurality of said reinforcing bars, said reinforcing framework comprising:

a plurality of confinement frames, each frame comprising:

a plurality of parallel transverse rods, each transverse rod having a first and second end, said transverse rods being attached to a first longitudinal rod proximate their first ends, and said transverse rods being attached to a second longitudinal rod proximate their second ends, said transverse rods being attached to said first and second longitudinal rods such that said transverse rods are oriented perpendicular to said longitudinal rods, and said first longitudinal rod is parallel to said second longitudinal rod, said longitudinal rods and said transverse rods defining a substantially planar confinement frame wherein consecutive transverse rods are spaced apart such that said longitudinal rods and said transverse rods define a network of openings in said frame;

wherein said planar confinement frames comprising said reinforcing framework are positioned such that each confinement frame lies in a plane that is substantially perpendicular to said vertical reinforcing bars and such that said confinement frames are oriented substantially parallel to each other in vertical alignment whereby consecutive confinement frames are aligned one above another with a separation space therebetween;

wherein said reinforcing framework is interlocked with said plurality of vertical reinforcing bars such that at least one of said openings in each of said frames accommodates a plurality of vertical reinforcing bars, wherein, in each frame, longitudinal and transverse rods meet at junctions, and wherein each confinement frame encompasses vertical reinforcing bars such that vertical reinforcing bars accommodated within a frame opening are positioned adjacent to said junctions, with a plurality of said vertical reinforcing bars being held in contact with said junctions by attachment means;

wherein vertically aligned openings in vertically aligned, spaced apart confinement frames define in the structure at least one continuous access passageway comprised of communicating openings sized for accommodating the use of concrete compacting equipment within said at least one access passageway, said at least one access passageway being defined, in part, by poured concrete thereabout, said confinement frames being devoid of any projections that would interject into said access passageway an obstruction to the use of concrete compacting equipment;

wherein said reinforcing framework further includes welded wire mesh that is vertically oriented parallel to said vertical reinforcing bars, said wire mesh being attached to said first ends of said transverse rods, said framework also including welded wire mesh that is attached to said second ends of the transverse rods; and wherein said first and second ends of the transverse rods are upturned so as to be bent at a substantially right angle with respect to midsection portions of the transverse rods, wherein bent ends of the transverse rods define hooks, and wherein said hooks provide means for attachment of said wire mesh to said first and second ends of the transverse rods, with said wire mesh being hung upon said hooks.

2. An improved structure as set forth in claim 1, wherein said wire mesh is secured to said hooks by fastening means.

3. An improved wall structure as set forth in claim 1, wherein all vertical reinforcing bars accommodated within frame openings are either in contact with one or more junctions or are spaced therefrom by a distance of not more than one-sixteenth of an inch.

4. An improved wall structure as set forth in claim 1, wherein four vertical reinforcing bars are disposed within each frame opening that accommodates said bars.

5. An improved wall structure as set forth in claim 1, wherein said attachment means provide means for allowing a fastening of a vertical reinforcing bar to a junction such that said bar is maintained in contact with both the longitudinal rod and the transverse rod comprising that junction to which the bar is fastened.

6. An improved wall structure as set forth in claim 1, wherein said transverse rods are welded to the underside of said longitudinal rods.

7. An improved structure as set forth in claim 1, wherein in each confinement frame, said transverse rods are positioned with spacing tolerance accuracy of plus or minus one-sixteenth of an inch maximum, thereby assuring physical contact between a plurality of vertical reinforcing bars and said transverse rods.

8. An improved earthquake resistant, load-bearing, concrete wall structure comprising:

a plurality of load bearing vertically oriented reinforcing bars of a given diameter;

a load-bearing concrete mass enveloping and bonded to all of said vertical reinforcing bars, said reinforcing bars and said concrete mass being interlocked by means of a reinforcing framework that is engaged by concrete poured thereabout and that encompasses a plurality of said reinforcing bars, said reinforcing framework comprising:

a plurality of confinement frames, each frame comprising:

a plurality of parallel transverse rods, each transverse rod having a first end and a second end, said transverse rods being attached to a first longitudinal rod proximate their first ends, and said transverse rods being attached to a second longitudinal rod proximate their second ends, said transverse rods being attached to said first and second longitudinal rods such that said transverse rods are oriented perpendicular to said longitudinal rods, and said first longitudinal rod is parallel to said second longitudinal rod, said longitudinal rods and said transverse rods defining a substantially planar confinement frame wherein consecutive transverse rods are spaced apart such that said longitudinal rods and said transverse rods define a network of openings in said frame;

wherein said planar confinement frames comprising said reinforcing framework are positioned such that each confinement frame lies in a plane that is substantially perpendicular to said vertical reinforcing bars and such that said confinement frames are oriented substantially parallel to each other in vertical alignment whereby consecutive confinement frames are aligned one above another with a separation space therebetween:

wherein said reinforcing framework is interlocked with said plurality of vertical reinforcing bars such that at least one of said openings in each of said frames accommodates a plurality of vertical reinforcing bars, wherein, in each frame, longitudinal and transverse rods meet at junctions, and wherein each confinement frame encompasses vertical reinforcing bars such that vertical reinforcing bars accommodated within a frame opening are positioned closely adjacent to said junctions.

wherein said first and second ends of the transverse rods are upturned so as to be bent at a substantially right angle with respect to midsection portions of the transverse rods, wherein bent ends of the transverse rods define hooks, and wherein said reinforcing framework further includes wire mesh that is vertically oriented so as to be parallel to said vertical reinforcing bars, said framework including wire mesh that is attached to said first ends of the transverse rods and additional wire mesh that is attached to said second ends of the transverse rods, wherein said hooks provide means for attaching wire mesh to said first and second ends of said transverse rods.

9. An improved wall structure as set forth in claim 8, wherein said confinement frames are arranged about said vertical reinforcing bars such that substantially all of said vertical bars are positioned not more than one-sixteenth of an inch away from a junction.

* * * * *